United States Patent [19]

Takeuchi et al.

[11] Patent Number: 4,892,023

[45] Date of Patent: Jan. 9, 1990

[54] ELECTRONIC KEYBOARD PERCUSSION INSTRUMENT

[75] Inventors: Akihiko Takeuchi; Masaaki Mizuguchi, both of Hamamatsu, Japan

[73] Assignee: Nippon Gakki Seizo Kabushiki Kaisha, Hamamatsu, Japan

[21] Appl. No.: 302,113

[22] Filed: Jan. 25, 1989

Related U.S. Application Data

[63] Continuation of Ser. No. 110,617, Oct. 19, 1987, abandoned, which is a continuation of Ser. No. 850,212, Apr. 10, 1986, abandoned.

[30] Foreign Application Priority Data

Apr. 16, 1985 [JP] Japan ..... 60-80913

[51] Int. Cl.[4] ..... G10H 1/053; G10H 1/34; G10H 5/02

[52] U.S. Cl. ..... 84/687; 84/DIG. 7; 84/704; 84/702; 84/730

[58] Field of Search ..... 84/1.04–1.15, 84/1.19–1.27, DIG. 7, DIG. 8, DIG. 20, DIG. 21, DIG. 24, 1.01

[56] References Cited

U.S. PATENT DOCUMENTS

| | | | |
|---|---|---|---|
| 3,229,021 | 1/1966 | Baschet | 84/1.14 |
| 3,542,936 | 11/1970 | Babicky | 84/1.06 |
| 3,558,310 | 6/1971 | Gschwandtner | 84/1.14 X |
| 3,684,814 | 8/1972 | Neustadt | 84/1.04 |
| 4,257,305 | 3/1981 | Friend et al. | 84/1.24 |
| 4,301,337 | 11/1981 | Eventoff | 84/DIG. 7 |
| 4,416,178 | 11/1983 | Ishida | 84/1.1 X |
| 4,444,083 | 4/1984 | Apel et al. | 84/423 R |
| 4,562,764 | 1/1986 | Marshall | 84/1.1 |

FOREIGN PATENT DOCUMENTS

| | | |
|---|---|---|
| 2934182 | 3/1980 | Fed. Rep. of Germany . |
| 3044384 | 8/1981 | Fed. Rep. of Germany . |
| 3247742 | 7/1983 | Fed. Rep. of Germany . |
| 52-48770 | 11/1977 | Japan . |
| 59-5912 | 2/1984 | Japan . |
| 1224055 | 3/1971 | United Kingdom . |

OTHER PUBLICATIONS

*Funkschau,* 1977, Heft 24, Piezotasten Sorgen fur Piano-effekt In Elektronischen Orgeln.

"Elektroakustik," *Funkschau,* 1977; Heft 24, pp. 1125 & 1126.

*Primary Examiner*—Stanley J. Witkowski

*Attorney, Agent, or Firm*—Blakely, Sokoloff, Taylor and Zafman

[57] ABSTRACT

An electronic keyboard percussion instrument includes a hammer such as a mallet, a plurality of plates, striking detection devices, and a musical tone generating section. The plates respectively correspond to note names of musical tones to be produced and aligned parallel to each other. The striking detection devices are respectively mounted on lower surfaces of the plates to detect striking of the plate with the mallet and to generate a striking detection signal. The musical tone generating section generates a musical tone of the note name corresponding to the struck plate in response to the striking detection signal. The striking detecting section may include a pressure sensitive element in order to make the musical tone responsive to a force striking the plate.

16 Claims, 7 Drawing Sheets

ELECTRONIC KEYBOARD PERCUSSION INSTRUMENT

This is a continuation of application Ser. No. 110,617 filed Oct. 19, 1987, now abandoned which is a continuation of application Ser. No. 850,212 filed Apr. 10, 1986 now abandoned.

BACKGROUND OF THE INVENTION

The present invention relates to an electronic keyboard percussion instrument which produces a tone having a pitch corresponding to a plate (a bar) struck by a small hammer such as a mallet as in a xylophone.

Xylophones, marimbas and vibraphones are known as acoustic keyboard percussion instruments. These keyboard percussion instruments have an arrangement consisting of a series of wooden or metal bars (plates) tuned chromatically with resonant frequencies corresponding to notes. The bars produce sounds upon selectively striking with a small hammer such as a mallet to produce a melody or the like.

Regarding electronic percussion instruments, conventional ones are exemplified by (a) a vibration sensor is mounted in a drum, and a detection output from the vibration sensor is amplified and produced at a loudspeaker and (b) a piezoelectric element is incorporated in a hammer (e.g., a stick or mallet) portion excluding a holding portion, and a voltage-controlled oscillator, a voltage-controlled filter or the like is driven in response to an output from the piezoelectric element to produce a musical tone signal (e.g., Japanese Utility Model Publication No. 59-5912).

In the acoustic keyboard percussion instruments described above, the shapes and dimensions of a series of bars are determined to produce desired sounds with predetermined pitches. In order to allow free vibrations of the bars, a proper gap is formed between each two adjacent bars. When the tone range of such musical instruments is widened, they are bulky and heavy. Therefore, playing and handling thereof is not easy.

Musical tone elements such as pitch, tone color, and volume are delicately changed according to striking forces and positions. Skilled striking techniques are required to control such delicate changes.

Furthermore, since the acoustic keyboard percussion instruments have particular tone colors, a player cannot enjoy different tone colors by playing a single acoustic keyboard percussion instrument.

The electronic percussion instruments (a) and (b) cannot selectively produce musical tones corresponding to the plurality of note names, unlike the acoustic keyboard percussion instruments, and melodies cannot be produced.

SUMMARY OF THE INVENTION

It is therefore an object of the present invention to provide an electronic keyboard percussion instrument which is compact and lightweight and can be easily played and handled.

It is another object of the present invention to provide an electronic keyboard percussion instrument played by striking with a hammer to make a melody in a variety of musical expressions.

It is still another object of the present invention to provide an electronic musical instrument which can easily provide a glissando effect.

It is still another object of the present invention to provide an electronic musical instrument which can provide a damper effect.

In order to achieve the above objects of the present invention, there is provided an electronic keyboard percussion instrument comprising: a striking member; a plurality of note plates respectively corresponding to note names of musical tones to be produced and aligned parallel to each other; a plurality of striking detecting means, respectively mounted on lower surfaces of the plurality of note plates, for detecting striking of the plate with the striking member and generating a striking detection signal; and musical tone generating means, responsive to the striking detection signal from the striking detecting means, for generating the musical tone of the note name corresponding to the struck plate.

DESCRIPTION OF THE PREFERRED EMBODIMENT

Figure 1:
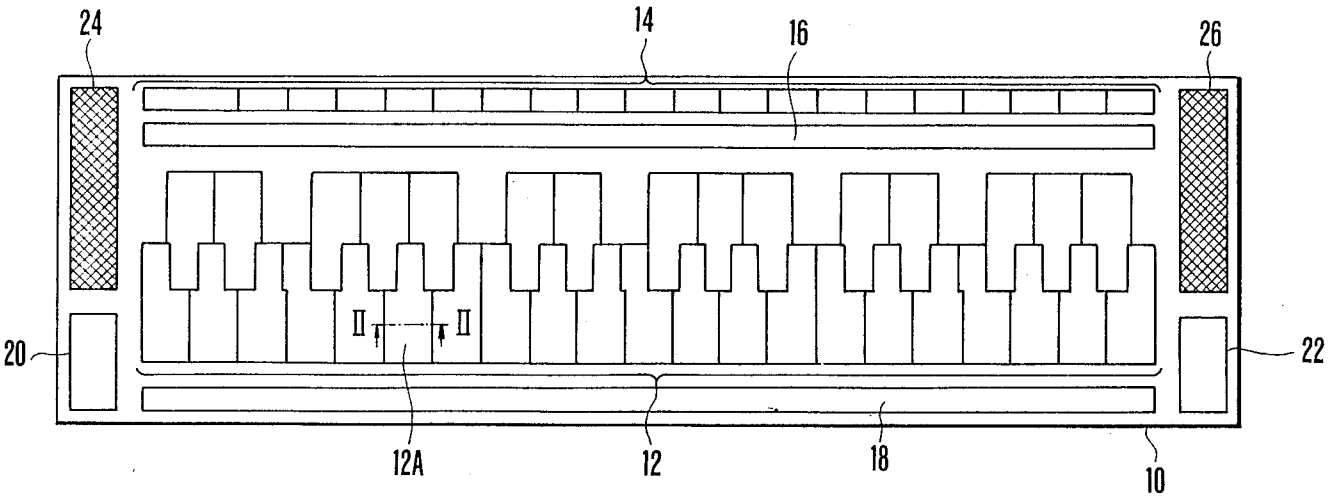
FIG. 1 is a plan view showing a panel of an electronic keyboard percussion instrument according to an embodiment of the present invention.

FIG. 1 shows a panel structure of an electronic musical instrument according to an embodiment of the present invention.

Panel Structure (FIG. 1)

A note name selection operation section 12, tone color selection switches 14, a portamento operation section 16, a damper operation section 18, first and second switch sections 20 and 22, and first and second loudspeakers 24 and 26 are arranged on the top surface of a housing 10. An electronic circuit is arranged in the housing 10 (to be described later with reference to FIGS. 7 to 9).

36 pressure sensitive plates (one plate is represented by reference numeral 12A) for three octaves are arranged in an order of tone names in the tone name selection operation section 12 and constitute a single flat surface. The shapes and arrangement of the pressure sensitive plates resemble those of an acoustic keyboard musical instrument. However, other shapes and arrangement of the pressure sensitive plates can be employed. The player selectively strikes with hammers such as mallets a large number of pressure sensitive plates in the note name selection operation section 12, thereby producing a melody or the like.

In the acoustic percussion musical instrument with bars, the musical tones are classified into natural tones corresponding to tone names C, D, E, F, G, A, and B, and chromatic tones corresponding to note names C♯, D♯, F♯, G♯, and A♯. In this embodiment, the pressure sensitive plates for the natural tones such as C, D, E, F, G, A, and B are interdigitally arranged with those for the chromatic tones such as C♯, D♯, F♯, G♯, and A♯ on the same plane. According to the pressure sensitive plate arrangement, a hammer such as a mallet is pressed at the interdigital portion of the pressure sensitive plates and is slid along the aligning direction of the pressure sensitive plates, thereby easily producing a glissando effect. The glissando effect cannot be obtained in the acoustic percussion musical instrument with bars.

The several arrangements of the pressure sensitive plates in the note name selection operation section 12 will be described later with reference to FIGS. 2 to 6.

The tone color selection switches 14 include a large number of tone color selection switches aligned in line. These switches respectively correspond to piano, electric piano, harpsichord I, harpsichord II, vibraphone, marimba, guitar, electric guitar, harp, pipeorgan, jazz organ, trumpet, saxophone, flute, clarinet, chaim, bell, string I, string II, bass, and electric bass. The player turns on one of the tone color selection switches to select a desired tone color. The player can enjoy different tone colors in a single musical instrument. Each tone color selection switch can comprise a pressure sensitive switch which can be selected upon striking of the switch with a mallet or the like.

The portamento operation section 16 includes a voltage divider of a pressure sensitive type extending along a pressure sensitive plate alignment direction of the note name selection operation section 12. A voltage-divided output is extracted from the voltage divider. The signal value of the voltage-divided output is continuously changed when the pressed position is changed along the direction of length of the voltage divider. A pitch is continuously changed between different tone names on the basis of the voltage-divided output. The player presses the portamento operation section 16 with the hammer such as a mallet and slides the mallet along the direction of its length, thereby easily producing the portamento effect.

The damper operation section 18 includes a pressure sensitive switch extending along the pressure sensitive plate aligning direction of the note name selection operation section 12. An ON signal from this switch is supplied to a musical tone generation section (to be described later) to abruptly damp the tone. The elongated damper operation section 18 is arranged in front of the note name selection operation section 12. Therefore, the player can easily obtain the damper effect in association with the note name selection operation. For example, the player strikes the pressure sensitive plate 12A with a mallet to produce a musical tone and then the damper operation section 18 with the mallet, so that the tone can be abruptly damped. This operation can also be applied to other pressure sensitive plates.

The first and second switch sections 20 and 22 include a power switch, a volume control switch, a tuning switch, a tremolo switch, a tremolo speed switch, a vibrato switch, a vibrato speed switch, a sustain effect switch, automatic rhythm switches (e.g., a rhythm selection switch, a start/stop switch, and a tempo switch), and automatic chord switches. These switches need not be arranged in the first and second switch sections, but can be properly arranged on a panel.

The first and second loudspeakers 24 and 26 convert to an acoustic sound a musical tone signal generated by the electronic circuit in the housing 10. One of the loudspeakers 24 and 26 can be omitted.

Pressure Sensitive Plate Arrangements (FIGS. 2 to 6)

Figure 2:
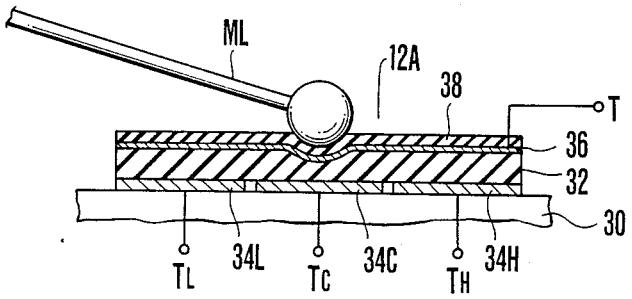
FIG. 2 is a sectional view of a pressure sensitive plate of the panel of FIG. 1 taken along the line II—II thereof.
Figure 3:
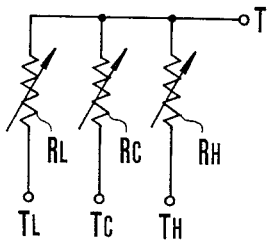
FIG. 3 is an equivalent circuit diagram of the pressure sensitive plate in FIG. 2.

FIG. 2 is a sectional view of the pressure sensitive plate 12A of FIG. 1 taken along the line II—II thereof, and other pressure sensitive plates have the same arrangement as the pressure sensitive plate 12.

The pressure sensitive plate 12A is mounted on an insulating substrate 30. The plate 12A consist of a conductive elastic member 32 of conductive foam rubber (resistivity is about 1 to 10 Ω·cm), three lower electrode members 34L, 34C and 34H formed on the lower surface of the elastic member 32 and parallel to each other, an upper electrode member 36 of highly conductive rubber (resistivity is about $10^{-2}$ Ω·cm) and formed on the upper surface of the elastic member 32, and a flat surface member, i.e., a flat plate 38 of, e.g., insulating rubber covering the upper electrode member 36. The surface member 38 may be coupled to surface members of other pressure sensitive plates. In other words, the common surface member may be used.

A terminal T is connected to the upper electrode member 36, and terminals TL, TC and TH are respectively connected to the lower electrode members 34L, 34C, and 34H. Variable resistors RL, RC and RH are connected between the terminal T and the terminals TL, TC and TH, as shown in the equivalent circuit diagram of FIG. 3. These resistors respond to striking pressure.

When the player strikes the upper surface of the pressure sensitive plate 12A with a hammer ML such as a mallet, a distance between the upper electrode member 36 and the lower electrode member 34L, 34C or 34H becomes short. At the same time, the resistivity of the conductive elastic member 32 at the striking position is decreased. Therefore, the resistance of the resistor RL, RC or RH is decreased accordingly. Striking/nonstriking, a striking force and a striking position can therefore be detected according to a change in resistance. When the plate 12A is struck with a large force, the musical tone generation section (to be described later) increases the volume level. When the player strikes a portion corresponding to the electrode member 34L, the resultant pitch is set to be slightly lower than that by striking a portion corresponding to the electrode member 34C, but is slightly higher than that by striking the portion corresponding to the electrode member 34H.

Figure 4:
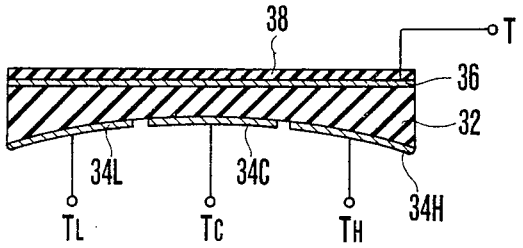
FIG. 4 is a sectional view of a pressure sensitive plate according to another embodiment of the present invention.

FIG. 4 shows a sectional structure of a pressure sensitive plate according to another embodiment of the present invention. The same reference numerals in FIG. 4 denote the same parts as in FIG. 2, and a detailed description thereof will be omitted. The embodiment of FIG. 4 features that the lower surface of a conductive elastic member 32 is arcuate upward. The portion corresponding to a lower electrode member 34C is more sensitive than the portion corresponding to the electrode member 34L or 34H. The thickness pattern of the pressure sensitive plate can be changed as needed.

Figure 5:
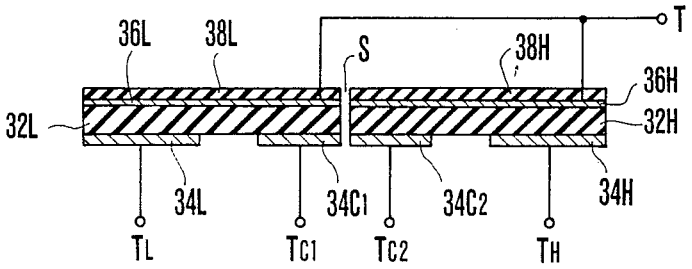
FIG. 5 is a sectional view of a pressure sensitive plate according to still another embodiment of the present invention.

FIG. 5 shows the sectional structure of a pressure sensitive plate according to still another embodiment of the present invention. The pressure sensitive plate is obtained by dividing the pressure sensitive plate of FIG. 2 into halves substantially at the center of the electrode member 34C, thus constituting right and left portions divided by a groove S. Referring to FIG. 5, the left divided members corresponding to those of FIG. 2 are represented by reference numerals affixed with "L", and the right divided members are represented by reference numerals affixed with "H". Lower electrode members 34C1 and 34C2 constituting the electrode member 34C of FIG. 2 are formed on the lower surfaces of conductive elastic members 32L and 32H, respectively. Terminals TC1 and TC2 are connected to the electrode members 34C1 and 34C2, respectively. A terminal T is commonly connected to upper electrode members 36L and 36H. Surface members 38L and 38H may be continuously formed.

With the arrangement of FIG. 5, striking can be independently detected at portions corresponding to the electrode members 34C1 and 34C2. The striking position corresponding to the groove S can be distinguished from the striking position in the left or right of the groove S, thereby achieving musical tone control with high precision.

Figure 6:
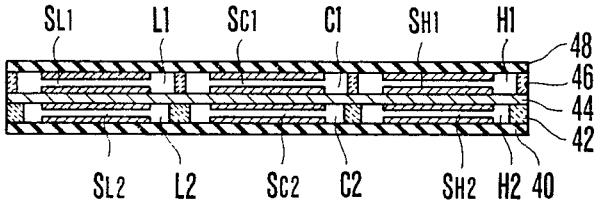
FIG. 6 is a sectional view of a pressure sensitive plate according to still another embodiment of the present invention.

FIG. 6 shows a sectional structure of a pressure sensitive plate according to still another embodiment of the present invention.

A second insulating plate 44 is formed on the surface of a first insulating plate 40 through a first elastic spacer 42. A third insulating plate 48 is formed on the surface of the second insulating plate 44 through a second elastic spacer 46. The second and third insulating plates 44 and 48 are flexible and made of, e.g., rubber. The first and second elastic spacers 42 and 46 are also made of rubber or the like. Three holes L2, C3 and H2 for switches are formed in the first elastic spacer 42. Holes L1, C1, and H1 corresponding to the holes L2, C2, and H2 are formed in the second elastic spacer 46.

Switches SL2, SC2, and SH2 are constituted by contact members formed on opposite surfaces of the first and second insulating plates 40 and 44 and are respectively formed in the holes L2, C2, and H2 of the first elastic spacer 42. Similarly, switches SL1, SC1, and SH1 are constituted by contact members formed on opposite surfaces of the second and third insulating plates 44 and 48 and are respectively formed in the holes L1, C1, and H1 of the second elastic spacer 46.

Portions of the first spacer 42 between the corresponding insulating plates are wider than those of the second spacer 46 between the corresponding insulating plates when viewed in a section. When the player strikes the portion corresponding to the switch SH1, for example, the switch SH1 is closed and then the switch SH2 is closed. This closing sequence is also applicable to the switches SC1 and SC2, and the switches SL1 and SL2. The closing time lag of the switch is substantially proportional to the striking force (or the striking speed). The time lag is electrically detected to perform the same musical control as in FIG. 2.

Figure 7:
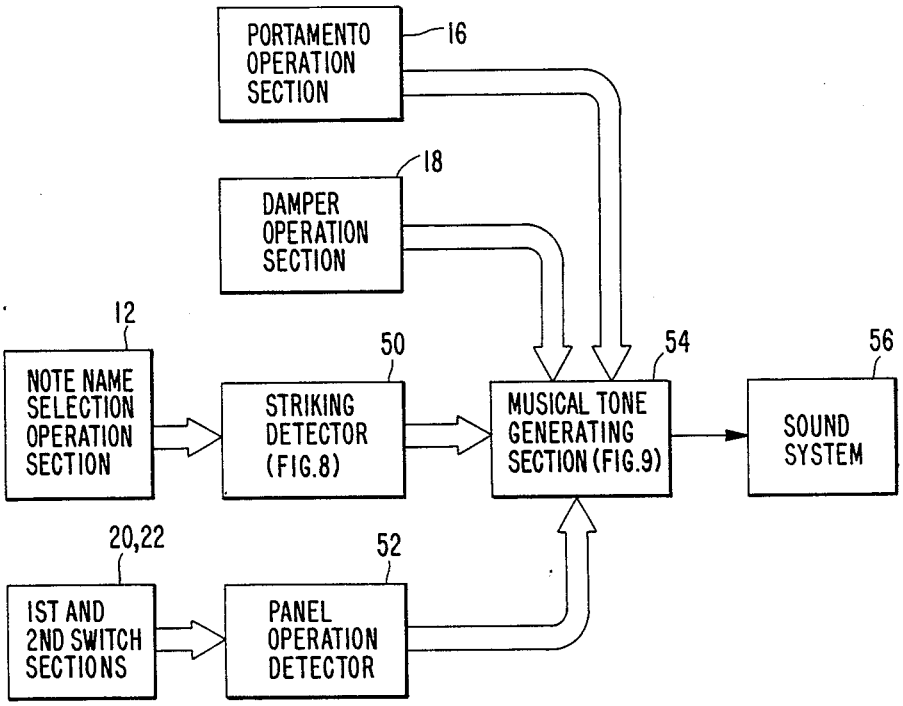
FIG. 7 is a block diagram of the electronic keyboard percussion instrument of the present invention.
Figure 8:
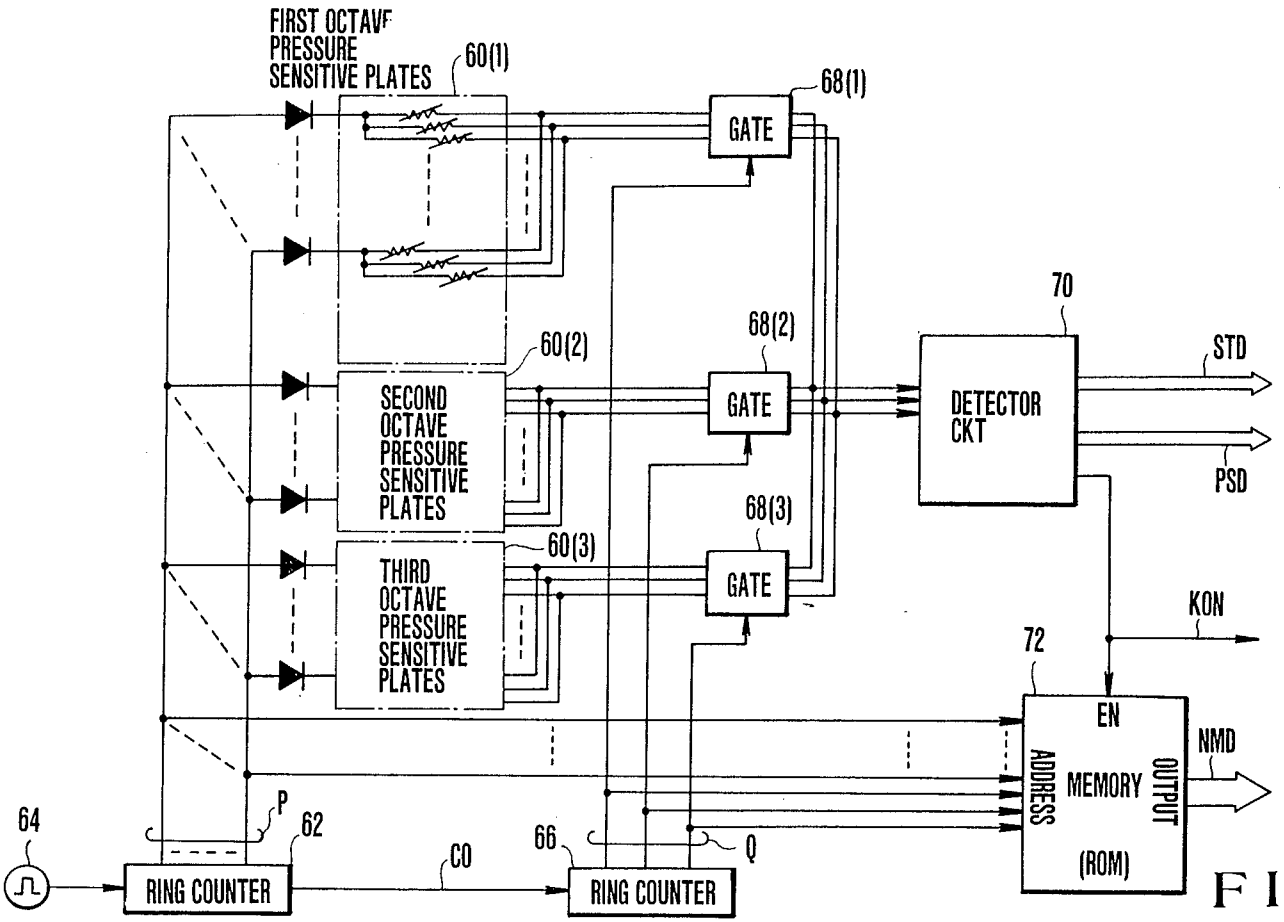
FIG. 8 is a block diagram of a striking detection section shown in FIG. 7.
Figure 9:
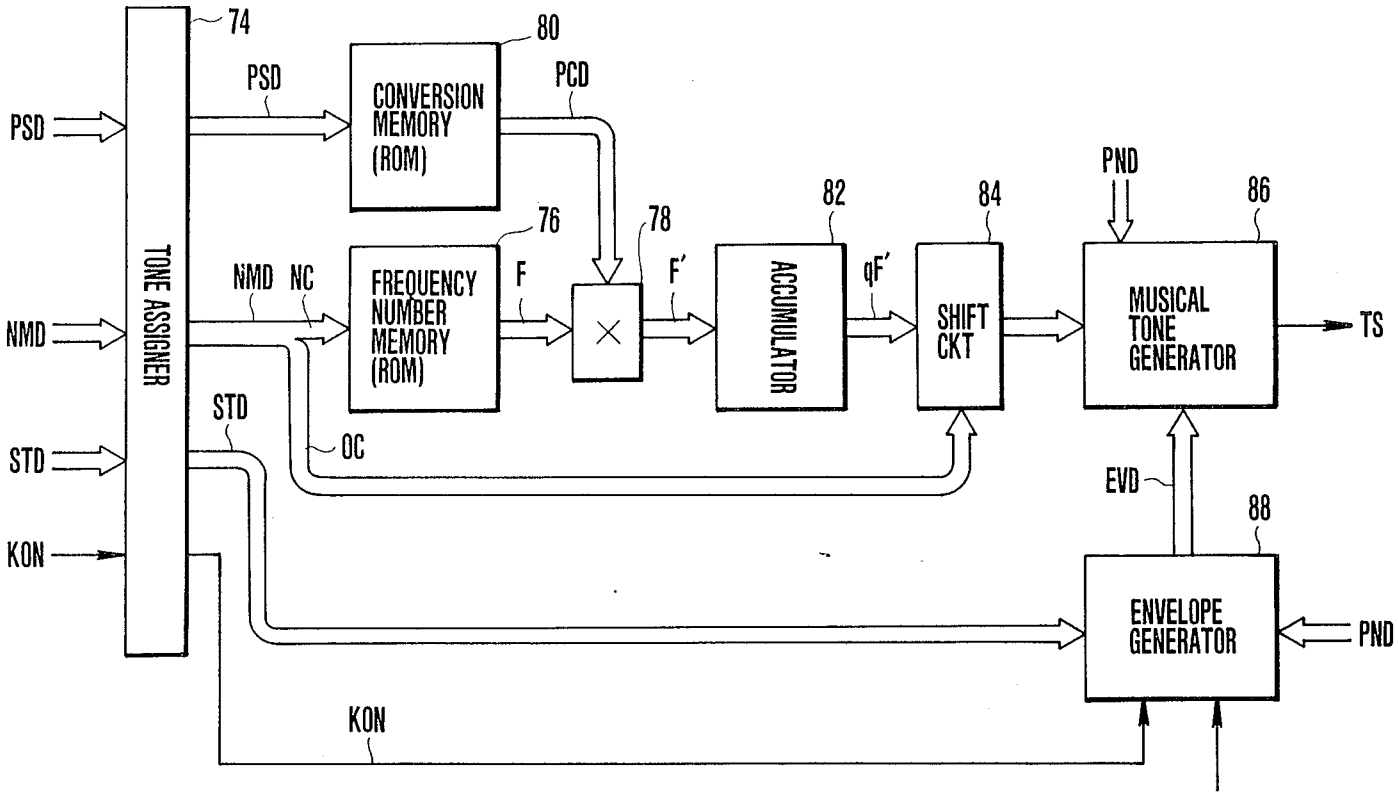
FIG. 9 is a block diagram of a musical tone generation section.

Circuit Arrangement (FIGS. 7 to 9)

FIG. 7 is a block diagram of the electronic musical instrument described above. This instrument consists of a striking detection section 50, a panel operation detector 52, a musical tone generation section 54, and a sound system 56.

The striking detection section 50 detects striking/nonstriking, striking forces, and striking positions of the large number of pressure sensitive plates in the note name selection control section 12 and supplies different control data to the musical tone generation section 54. A detailed arrangement of the striking detection section 50 will be made with reference to FIG. 8.

The panel operation detector 52 detects operation/nonoperation and a volume level of each switch in the sections 20 and 22, excluding the switches in the note name selection operation section 12, and supplies different control signals to the musical tone generation section 54.

The musical tone generation section 54 generates a musical tone according to control signals from the striking detection section 50, the panel operation section 54, the damper operation section 18, and the portamento operation section 10. A detailed arrangement of the musical tone generation section 54 will be described later with reference to FIG. 9.

The sound system 56 includes first and second loudspeakers 24 and 28, an output amplifier, and so on and produces a musical tone corresponding to the musical tone signal from the musical tone generation section 54.

Striking Detector (FIG. 8)

FIG. 8 shows a detailed arrangement of the striking detection section 50.

A large number of pressure sensitive plates in the tone name selection operation section 12 are classified into first octave pressure sensitive plates 60(1), second octave pressure sensitive plates 60(2), and third octave pressure sensitive plates 60(3).

A ring counter 62 counts clock pulses from a clock source 64 and sequentially generates note scanning pulse outputs P. A ring counter 66 counts carry out pulses CO from the ring counter 62 and sequentially generates octave scanning pulse outputs Q.

The 12-note pressure sensitive plates in each of the pressure sensitive plates 60(1) to 60(3) are sequentially and repeatedly scanned in response to pulse outputs P. Scanned outputs from the respective pressure sensitive plates 60(1) to 60(3) are supplied to gate circuits 68(1) to 68(3). The gate circuits 68(1) to 68(3) are sequentially and repeatedly enabled in response to the pulse outputs Q. Outputs from the gate circuits 68(1) to 68(3) are supplied to a detector 70. Thus, an electrical signal corresponding to the resistance of a variable resistor of each pressure sensitive plate is supplied to the detector 70.

The detector 70 detects striking/nonstriking, a striking force, and a striking position according to electrical signals upon note and octave scanning. When the player strikes a given plate, the detector 70 generates a key on signal KON, striking force data STD, and striking position data PSD.

A memory 72 stores note name data representing a note name of each pressure sensitive plate in a combination of a note code and an octave code. The memory 72 receives as address inputs the output P from the ring counter 62 and the output Q from the ring counter 66.

The key on signal KON is supplied as an enable signal EN to the memory 72. When the key on signal KON is generated upon striking of a specific pressure sensitive plate, note name data representing the note name of the struck pressure sensitive plate is read out from the memory 72.

Musical Tone Generator (FIG. 9)

FIG. 9 shows a detailed arrangement of the musical tone generation section 54.

A tone assigner 74 assigns the key on signal KON, striking force data STD, note name data NMD, and striking position data PSD to a proper one of a plurality of time-divisional tone channels, and sends these kinds of data at the timing of the selected channel. For example, when the player simultaneously strikes two pressure sensitive plates, data of these pressure sensitive plates are assigned to different tone channels and are time-divisionally sent from the tone assigner 74. The time division processing is also performed in digital musical tone generation to be described below. The electronic musical instrument can generate a polyphonic sound.

A frequency number memory 76 comprises a ROM for storing predetermined frequency number data associated with the common 12 note names of the pressure sensitive plates 60(1) to 60(3). When the tone assigner 74 sends out note name data NMD representing the specific pressure sensitive plate, frequency number data F corresponding to the nose code data NC in the data NMD is read out from the memory 76 and is supplied to a multiplier 78.

A conversion memory 80 comprises a ROM for storing pitch control data representing different pitches according to different striking positions within each pressure sensitive plate. For example, in the case of the pressure sensitive plate of FIG. 3, three pitch control data signals respectively corresponding to the electrode members 34L, 34C, and 34H are stored in the conversion memory 80. If the value of the pitch control data corresponding to the electrode member 34C is given as 1, the value of the pitch control data corresponding to the electrode member 34L is slightly smaller than 1, and the value of the pitch control data corresponding to the electrode member 34L is slightly larger than 1. The striking position data PSD from the tone assigner 74 is converted by the memory 80 to pitch control data PCD which is then supplied to the multiplier 78.

The multiplier 78 multiplies the frequency number data F from the memory 76 with the pitch control data PCD from the memory 80, and sends out frequency number data F′ corresponding to a multiplication result.

The frequency number data F′ from the multiplier 78 is supplied to and accumulated by an accumulator 82. The accumulator 82 accumulates the frequency number data F′ When the accumulated amount reaches a predetermined maximum value, the accumulator 82 is reset and starts accumulation again. In this sense, the accumulation cycle depends on the frequency number data F′. The frequency number is increased when the pitch is higher. The accumulation cycle is thus decreased when notes with higher pitches are accumulated.

The accumulator 82 supplies accumulation data qF′ (where q is the number of times of accumulation, and F′ is the value of the frequency number data F′) to a shift circuit 84.

The shift circuit 84 bit-shifts the accumulation data qF′ in accordance with the octave code data OC in the note name data NMD to specify an octave. The octave-specified accumulation data is supplied from the shift circuit 84 to a musical tone generator 86.

The musical tone signal generator 86 includes a waveshape memory for storing waveshape sampled data of one cycle for each tone color of the musical instruments as previously described. Tone color specifying data (data representing the tone color selected by the corresponding tone color selection switch) in panel data PND from the panel operation detector 52 of FIG. 7 specifies corresponding waveshape sampled data. The sampled data of the musical tone waveshape with a selected tone color is read out from the waveshape memory in response to the octave-specified accumulation data from the shift circuit 84. In this case, waveshape sampled data is read out at a rate corresponding to the accumulation repetition frequency. The pitch corresponding to the note name of the struck pressure sensitive plate is given to the readout data.

An envelope generator 88 includes a waveshape memory for storing sampled data (envelope data) of envelope waveshape of each tone color. Specific envelope data of the tone color is read out in response to tone color specifying data in the panel data PND. The envelope data corresponding to the selected tone color is read out in response to the key on signal KON. The readout envelope data is corrected to obtain a steep leading edge in response to the striking force data STD when the striking force is large. The corrected envelope data EVD is supplied to the musical tone generator 86. The envelope generator 88 also receives the signal from the damper operation section 18 and generates envelope data EVD for abruptly damping the tone.

The musical tone signal generator 86 multiplies the musical tone waveshape sampled value with the envelope data EVD. A product signal serves as a digital musical tone signal.

Accumulation of the accumulator 82, envelope data generation of the envelope generator 88, digital musical tone signal generation of the musical tone signal generator 86 are time-divisionally synchronized with channel assignment of the tone assigner 74. Upon simultaneous striking of a plurality of pressure sensitive plates, the digital musical tone signals corresponding to the struck pressure sensitive plates are time-divisionally produced at the corresponding channels.

The digital musical tone signals of the respective channels are added and D/A converted by the musical tone signal generator 86 to generate an analog musical tone signal TS. The signal TS is supplied to the sound system 56 of FIG. 7 and is produced as a tone.

According to the present invention, a plurality of pressure sensitive plates corresponding to tone names are arranged, striking of each pressure sensitive plate is detected, and musical tone signals corresponding to the tone names are electronically produced, thereby realizing a compact and lightweight electronic keyboard percussion instrument which can produce a melody.

When the striking force data or the striking position data from each pressure sensitive plate is detected to control the musical tone parameters such as pitch, tone color and volume level, a variety of play modes can be achieved. Even a beginner without advanced skills can enjoy a variety of skilled techniques.

According to the embodiments as described above, when tone color selection, effects, tuning, glissando, portamento, automatic rhythm, and automatic chord functions are provided, a variety of musical performances can be enjoyed in the same manner as in the conventional electronic keyboard musical instrument, although the playing style is the same as in an acoustic percussion musical instrument.

Figure 10:
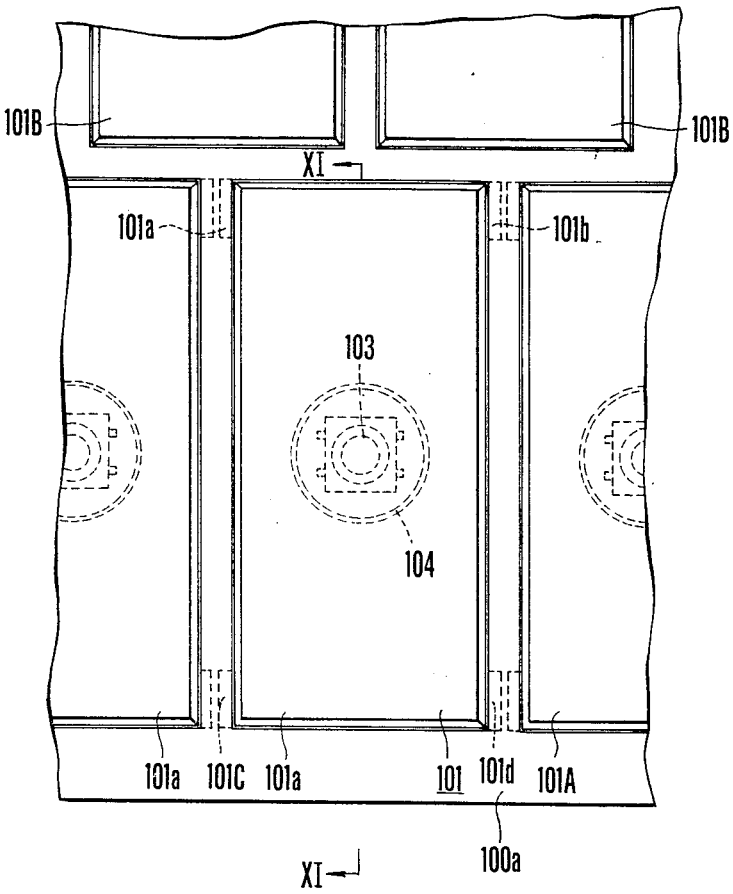
FIG. 10. is a plan view of a panel of an electronic keyboard percussion instrument according to still another embodiment of the present invention.
Figure 11:
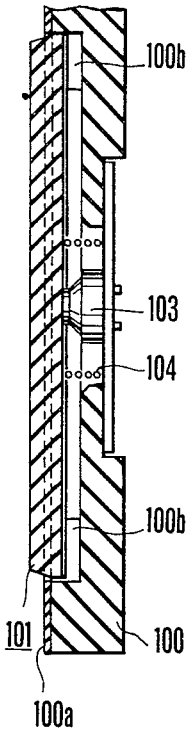
FIG. 11. is a sectional view of the panel shown in FIG. 10 taken along the line XI—XI thereof.

FIGS. 10 and 11 show still another embodiment of the present invention. Flat plates 101A and 101B correspond to note names of the musical tones to be produced and are aligned parallel to each other. More specifically, the flat plates are made of ABS resin, aluminum, synthetic rubber or the like. The flat plates 101A corresponding to the note names corresponding to the natural tones are aligned parallel to each other, and the flat plates 101B corresponding to the note names of chromatic tones are aligned parallel to each other but offset from the plates 101A along their aligning direction so as to allow simultaneous striking of the adjacent plates 101A and 101B. Each flat plate has a rectangular shape. Guides/stoppers 101*a* to 101*d* are arranged to allow vertical movement of each flat plate. These guides/stoppers 101*a* to 101*d* are moved along grooves 100*b* in a substrate 100 and are stopped by the upper plate 100*a* of the substrate 100.

A switch 103 is arranged at the center of the lower surface of each plate. A coil spring 104 is arranged around the switch 103 to bias the plate upward.

With this arrangement, when the player strikes one of the flat plates with a hammer such as a mallet, the flat plate is moved downward against the biasing force of the spring 104 to actuate the switch 103. The key on signal is then generated by the switch 103. Processing of the key on signal is the same as in the previous embodiments. In this embodiment, only one switch is arranged at the center of the striking means. Another switch may be arranged around the switch. Alternatively, the switches may be arranged in a matrix form.

Figure 12:
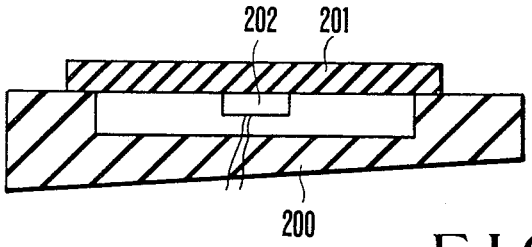
FIG. 12 is a sectional view of a panel of an electronic keyboard percussion instrument according to still another embodiment of the present invention.

FIG. 12 shows still another embodiment of the present invention. A flat plate 201 is arranged on a substrate 200, and a piezoelectric element 202 is attached to the lower surface of the plate 201. The flat plates are arranged corresponding to the note names of the musical tones, as shown in FIG. 1 or FIG. 10 to obtain the same effect as in the previous embodiments.

The present invention is not limited to the particular embodiments described above. Various changes and modifications may be made within the spirit and scope of the invention. For example, the lower electrode member is divided into three portions along the direction of width of the pressure sensitive plate 12A in FIG. 2. However, the lower electrode member may be divided into three portions along the longitudinal direction or into four or more portions.

A plurality of flat plates are arranged on the single substrate in the above embodiments. However, a plurality of units consisting of octave flat plates may be prepared, and the units are connected to a coupling means as needed.

What is claimed is:

1. An electronic keyboard percussion instrument of a type to be struck with a striking member by a player comprising:

a plurality of pressure sensitive plates respectively corresponding to note names of musical tones to be produced and aligned parallel to each other;

a plurality of striking detecting means, each of which detects when a corresponding pressure sensitive plate is struck with said striking member by the player and generates a first striking detection signal representing a note name of the struck pressure sensitive plate and further generates a second striking detection signal representing a musical tone element modifier characteristic of a manner in which the player has struck the struck pressure sensitive plate;

a tone assignor for assigning said first and second striking detection signals to one of a plurality of tone channels; and musical tone generating means coupled to said plurality of tone channels for generating a musical tone corresponding to said note name and said musical tone element modifier.

2. An electronic keyboard percussion instrument according to claim 1, wherein each of said striking detecting means comprises a switch which becomes closed when the corresponding pressure sensitive plate is struck and becomes open when said corresponding pressure sensitive plate is not struck.

3. An electronic keyboard percussion instrument according to claim 2, wherein said switch comprises one pair of opposite electrodes normally separated from each other by a predetermined space.

4. An electronic keyboard percussion instrument according to claim 2, wherein said switch comprises two pairs of opposite electrodes normally separated from each other by a predetermined distance, said two pairs being adapted to overlay.

5. An electronic keyboard percussion instrument according to claim 2, further comprising a spring for normally biasing to normally open said switch, said switch being tilted at the center of said corresponding pressure sensitive plate.

6. An electronic keyboard percussion instrument according to claim 1, wherein said striking detecting means comprises a pressure sensitive element and a pair of electrodes disposed against the upper and lower surfaces of said pressure sensitive element.

7. An electronic keyboard percussion instrument according to claim 6, wherein said second striking detection signal represents a force striking said corresponding pressure sensitive plate with said striking member.

8. An electronic keyboard percussion instrument according to claim 6, wherein one of said pair of electrodes is divided into at least two blocks.

9. An electronic keyboard percussion instrument according to claim 6, wherein an element of said musical tone is modified according to said second striking detection signal.

10. An electronic keyboard percussion instrument according to claim 6, wherein said pressure sensitive element comprises a piezoelectric element.

11. An electronic keyboard percussion instrument according to claim 1, wherein a first plurality of pressure sensitive note plates correspond to note names of natural tones and a second plurality of pressure sensitive plates correspond to note names of chromatic tones.

12. An electronic keyboard percussion instrument according to claim 11, wherein said pressure sensitive plates corresponding to said note names of chromatic tones are partially inserted between predetermined adjacent ones of said pressure sensitive plates corresponding to the note names of natural tones.

13. An electronic keyboard percussion instrument according to claim 11, wherein said pressure sensitive plates corresponding to said note names of natural tones among said plurality of said pressure sensitive plates, are offset from said pressure sensitive plates corresponding to said note names of chromatic tones so as to allow simultaneous striking of adjacent pressure sensitive plates corresponding to said notes of the natural and chromatic tones.

14. An electronic keyboard percussion instrument according to claim 1, wherein a damper operation section is arranged in an aligned direction of said plates.

15. An electronic keyboard percussion instrument according to claim 1, further comprising tone color selecting means for selecting a tone color to be imparted to said musical tone.

16. An electronic keyboard percussion instrument according to claim 1, wherein said plurality of pressure sensitive plates and said striking detecting means are formed on a single substrate.

* * * * *